US006000198A

United States Patent [19]

Tramposch

[11] Patent Number: 6,000,198

[45] Date of Patent: Dec. 14, 1999

[54] METHOD AND PACKAGE FOR PACKAGING CONTENTS AT REDUCED PRESSURES

[75] Inventor: Walter G. Tramposch, Moon Township, Pa.

[73] Assignee: Calgon Carbon Corporation, Pittsburgh, Pa.

[21] Appl. No.: 09/056,406

[22] Filed: Apr. 7, 1998

[51] Int. Cl.[6] ..... B65B 31/00

[52] U.S. Cl. ..... 53/432; 53/400

[58] Field of Search ..... 53/432, 434, 400, 53/402, 403, 510, 512, 440, 127, 111 RC, 474, 155, 238

[56] References Cited

U.S. PATENT DOCUMENTS

| | | | |
|---|---|---|---|
| 3,670,874 | 6/1972 | Brunner | 206/46 PV |
| 4,061,807 | 12/1977 | Shaler et al. | 428/36 |
| 4,668,551 | 5/1987 | Kawasaki et al. | 428/69 |
| 4,981,007 | 1/1991 | Shima et al. | 53/432 |
| 5,009,308 | 4/1991 | Cullen et al. | 206/204 |
| 5,328,671 | 7/1994 | Rockenfeller | 423/210 |
| 5,505,892 | 4/1996 | Domme | 264/29.6 |
| 5,685,986 | 11/1997 | Yamada et al. | 210/496 |
| 5,779,643 | 9/1998 | Kashiba | 53/400 |

FOREIGN PATENT DOCUMENTS

| | | |
|---|---|---|
| 1069929 | 5/1967 | United Kingdom . |

*Primary Examiner*—Joseph J. Hail, III
*Assistant Examiner*—Dermott Cooke
*Attorney, Agent, or Firm*—Titus & McConomy LLP

[57] ABSTRACT

A package and method for the packaging of contents at a reduced pressure which provides for improved protection of said materials from contamination. The method includes hermetically sealing a gas and vapor impermeable packaging containing both the material, object, and/or device and an adsorbent at elevated temperature. Subsequent cooling of the adsorbent results in the production of a partial vacuum within the packaging. Alternatively, if the packaging is evacuated prior to sealing by use of some mechanical device, the subsequent cooling of the adsorbent results in a further reduction of the interior pressure of the packaging. The improvement is provided by the presence of the cooled adsorbent in the packaging. Due to the presence of the cooled adsorbent within the packaging, the vacuum within the packaging is produced or increased and more readily maintained due to the adsorptive action of the adsorbent. Also, the vapor pressure of any gas or vapor contaminates remaining in the packaging or generated or otherwise released by the materials within or containing this partial vacuum are further reduced by the action of the adsorbent. This rate of this reduction is increased as a result of the partial vacuum within the packaging.

19 Claims, 1 Drawing Sheet

METHOD AND PACKAGE FOR PACKAGING CONTENTS AT REDUCED PRESSURES

FIELD OF THE INVENTION

The present invention relates to a method and package for vacuum packaging materials, objects, and/or devices at reduced pressures, and, in particular, to a hermetically sealable gas impermeable container having at least one highly microporous heatable adsorbent contained therein in which the adsorbent is raised to a higher than ambient temperature immediately prior to sealing.

BACKGROUND OF THE INVENTION

Since earliest times, materials, objects, and devices have been packaged to reduce contamination during transport or storage. This packaging has utilized a variety of vessels, fabricated from various objects, in an effort to prevent the contamination of the vessels contents from environmental and other sources. Today, packaging is still used for the same purposes. But, the demands placed upon this packaging often exceeds that previously encountered. For example, exposure of many sensitive electronic devices and objects to contaminates is detrimental. In an attempt to control low-level exposure, such devices are packaged in "clean rooms" or in other controlled environments. For many such devices, selection of the packaging materials is as important as the method of packaging. Packaging materials are selected so that contamination caused by the materials of construction of the packaging material is minimized.

Currently, low-level contamination of packaged objects is reduced or eliminated by use of any of four methods. These methods include hermetic sealing, vacuum packaging (which includes hermetic sealing), chemical reaction, and physical adsorption. Hermetic sealing is easily accomplished by package design or by selection of the materials of construction of the package. For example, the common glass jar with lid typically provides a good hermetic seal. This is especially true if the lid is gasketed. Hermetic sealing can also be easily accomplished by use of suitable "plastic" bags equipped with locking seals or heat sealing capability.

Vacuum packaging is also used to prevent low-level contamination. Vacuum packaging involves hermetic sealing along with evacuation of the interior of the packaging. Typically, vacuum packaging requires careful consideration of the packaging design and materials of construction. The package must be designed such that it is possible to apply a hermetic seal while maintaining a suitable interior vacuum. The materials of construction must be selected such that the environmental pressure does not destroy the package's integrity. These materials must also inhibit gas or vapor transport through the package. The materials of construction must also be such that they do not in and of themselves contaminate the packaged object. Therefore, materials that outgas under vacuum are normally avoided. This technique is not as typically employed as hermetic sealing, generally because of the apparatus and procedures, and associated cost, necessary to vacuum package. Accordingly, only those objects most sensitive to the effects of contamination are packaged in evacuated packages due to the complexities and costs involved.

Chemical adsorption of contaminates in packaging is rarely practiced, except in the case of electrical devices. For example, light bulbs are typically supplied with a device referred to as a "getter". This device serves to remove by chemical reaction significant contaminates within the bulb, which may damage the light emitting filament during use, after sealing and prior to final packaging.

The packaging of adsorbents with contents sensitive to contamination is well known. Suitable physical adsorbents include activated carbon or zeolites. For example, small packets of silica gel are commonly placed in packages containing sensitive mechanical devices to lower the humidity within the vessel in order to inhibit the formation of rust or other types of corrosion. Such packets are also introduced into packages containing electronic devices and some food stuffs. The application of this technique is so well known and wide spread that various package sizes of silica gel are sold to consumers for use in containers of their own choosing. Although relatively effective, this technique has certain inherent limitations. For example, the diffusion of water vapor is relatively slow at atmospheric pressure. Therefore, silica gel packets are best distributed throughout the container to provide shorter diffusion paths. Also, as the containers are not typically hermetically sealed, the water capacity of the silica gel packets can be readily exhausted in high humidity environments.

To date, physical adsorption has not been used in combination with vacuum packaging to reduce low-level contamination. Such a combination would be advantageous from the aspect that any contaminate present in the vapor phase within the evacuated packaging would be essentially removed by the adsorbent. It is believed, however, that an inherent characteristic of physical adsorbents limits their usefulness in such applications. It is very difficult to remove adsorbed materials from adsorbents by simple application of vacuum. Therefore, inclusion of adsorbents in packages to be hermetically vacuum sealed would lead to excessively long evacuation times. Also, even evacuated, the adsorbent would continue to desorb gases and vapors unless the evacuation time period was extremely long. This desorption would then compromise the package vacuum.

The ability of adsorbents to adsorb gases, even at low pressures is well known. Activated carbons have been used to store liquefied gases (U.S. Pat. No. 2,760,598) and as a means to maintain vacuum in closed vessels (U.S. Pat. No. 3,921,844). It is also know that cooling the carbon increases it's effectiveness.

Accordingly, it is the object of the present invention to provide a method for vacuum packaging materials, objects, and devices which provides for improved protection from contamination. It is another object of the invention to provide a package or means for hermetically sealing an object at reduced atmosphere. It is a further object of the invention to provide both a method and means for facilitating hermetically packaging objects at reduced atmosphere without the need for out gassing the package prior to sealing.

SUMMARY OF THE INVENTION

The present invention provides a method and package for packaging objects such as, for example, electronic components, chemicals and other materials or foodstuff. Generally the present invention provides improved protection for such objects from contamination. In a preferred embodiment of the invention, a hermetically sealable gas impermeable package is provided in which a highly microporous adsorbent is contained. Prior to sealing an object in the package of the present invention the adsorbent is heated, preferably 10° to 20° above ambient packaging temperature. Numerous methods for heating the adsorbent are available such microwaves and the like or the adsorbent can be heated in a furnace just prior to the object being placed in the package for sealing. For certain objects that are not effected by increased temperature, they can be heated with the adsorbent just prior to packaging.

Thus, the method generally involves hermetically sealing a gas and vapor impermeable package containing both the object and an adsorbent at elevated temperature. Subsequent cooling of the adsorbent results in the production of a partial vacuum within the package. Alternatively, if the package is evacuated prior to sealing by use of a mechanical device or pump, for example, the subsequent cooling of the adsorbent results in a further reduction of the interior pressure of the package. The improvement is provided by having the adsorbent at an elevated temperature when the packaging is hermetically sealed. Heating of the adsorbent prior to hermetic sealing drives off many of the adsorbed gases and vapors entrapped within the adsorbent at ambient temperature.

After sealing and subsequent cooling of the adsorbent, the gases and vapors entrapped within the packaging are then adsorbed. This adsorption creates a vacuum in those instances where the contents of the packaging were sealed under atmospheric pressure. If the packaging was evacuated prior to sealing, the action of the cooled adsorbent further reduces the pressure within the packaging. Furthermore, due to the presence of the cooled adsorbent within the packaging, the vacuum within the packaging is more readily maintained due to the adsorptive action of the adsorbent. Also, the vapor pressure of any gas or vapor contaminates remaining in the packaging or generated or otherwise released by the materials within or containing this partial vacuum are further reduced by the action of the adsorbent. This rate of this reduction is increased as a result of the partial vacuum within the packaging.

In practice, the adsorbent can be activated carbon, zeolite, silica gel, molecular sieve, polymeric adsorbent, and/or any other adsorbent alone or in combination. Any adsorbent having physical adsorption capacity, known to as "activity" by those skilled in the art, may be used in the present invention. Those adsorbents having higher physical adsorption capacities or high microporosity are preferred. Also useful are adsorbents of the type for which chemical adsorption occurs in conjunction with physical adsorption. Such adsorbents or impregnated adsorbents also may effect the removal of some contaminates by chemical adsorption in combination with physical adsorption. The adsorbent may be of any physical form, including powdered, granular, pelletized, spherical, cloth, and/or formed into blocks, sheets, or other geometric structures. Activated carbon cloth is a preferred adsorbent due to its flexibility, ease in handling, and typically high adsorptive capacity.

If desired, the adsorbent may be placed into a porous and/or ventilated container, such a cloth bag, prior to or during insertion into the packaging. Such a container normally facilitate handling and reduce unintended distribution of the adsorbent throughout the interior volume of the packaging. It is most preferred that such packaging be capable of withstanding the temperature to which the adsorbent is heated prior to sealing and that the packaging materials not in and of themselves release any gases or vapors. Alternatively, the adsorbent may be incorporated into the inner walls of the packaging. Such incorporation could provide increased flexibility in the practice of the present invention.

Selection of the adsorbent is preferably based on the expected contaminates within the packaging. Adsorbents such as silica gels are known to be especially good water adsorbers. Therefore, such adsorbents are typically more suitable for use in instances where water vapor may be the principle contaminate of interest. It is also know that activated carbons are particularly efficient hydrocarbon absorbers and, thus, the adsorbent of choice in packaging applications where hydrocarbons are potentially the most significant contaminate. A example of such an application is the storage of fruit where the control of oxygen and carbon dioxide levels results in increased storage lifetimes (Canadian Pat. No. 794,298). Alternatively, the adsorbent can be of a type known to be particularly effective for the removal of particular contaminates of interest by chemical adsorption or reaction. Such an adsorbent, for example, is a specially prepared carbon or adsorbent impregnated with a material to increase their physical or chemical adsorption capacity.

Typically a small amount of adsorbent is needed for use in the present invention. The amount depends on the adsorbent type and activity, the interior volume of the packaging, and the elevated temperature to which the adsorbent is to be heated prior to sealing the packaging. There are well known theoretical and experimental methods for determining the amount of adsorbent required for a given set of packaging conditions. For example, it is known that 1 gram of an adsorbent with a surface area of greater than 1000 $m^2$/gram, has a capacity to adsorb 8 mL of nitrogen, the major component of air, at 30° C. (Meredith, et al. 1967). Thus, an adsorbent having a density of 0.5 gram/mL means the adsorbent has the capacity removing four times its volume of air within a package.

The contents intended for packaging may be any that do not have an appreciable vapor pressure and which tolerate storage under vacuum conditions. Examples of contents such as electronic components, machines, chemicals, fruits, vegetables, grains, art works, fabricated metal, ceramic, wood, books, newspapers, magazines, papers, glass, electronic assemblies, tools, metallic objects, ceramics, plastics, freeze-dried materials, dried foods, measuring devices, sensors, and some chemicals are suitable contents for the method and packaging of the present invention. Other objects or devices having exhibiting vapor pressures can be also be packaged using the present invention by judicious selection of the adsorbent. An example of this is the use of a sorbent for packaging coffee to remove carbon dioxide (U.S. Pat. No. 4,552,767).

The packaging can be any container which can be hermetically sealed. The packaging can be fabricated from any material desired if the use of such material provides for the fabrication of a packaging that can be hermetically sealed and maintain a vacuum. The material from which the packaging is fabricated preferable does not liberate any contaminates or chemically interact with the adsorbent or the contents intended for packaging. Furthermore, it is especially desirable that the packaging be capable of tolerating the required temperature increase resulting from the use of a heated adsorbent or of heating the adsorbent. Packaging suitable for the present invention include, but are not limited to, bottles, drums, bags, boxes, and irregularly shaped containers produced by molding, stamping, or otherwise forming metal, glass, and/or plastic.

The adsorbent can be heated to an elevated temperature prior to placement into the used for packaging. Alternatively, the adsorbent can be heated in the packaging. By either method, the materials, objects, and/or devices intended for packaging may be in the packaging before or after the addition of the adsorbent. The method selected is dependent on the sensitivity of the contents to elevated temperatures. If desired, a separator of suitable composition may be placed between the adsorbent and contents to be packaged to inhibit heat transfer therebetween. Heating of the adsorbent can be accomplished using any conventional heat source including, but not limited to, ovens, microwaves, resistance vessel heaters, or hot gases.

It is desired that the elevated temperature to which the adsorbent is heated is as high as possible based on either the materials of construction of the packaging, the materials of construction or composition of the materials, objects, and/or devices intended for packaging, or the maximum temperature to which the adsorbent can be exposed without inducing damage. In practice, the maximum temperature to which the adsorbent can be exposed is usually limited by the materials of construction of the packaging. Lower adsorbent temperatures can be used with a corresponding decrease in the subsequent effectiveness of the adsorbent.

The present invention can be practiced in an air or inert gas environment. If the adsorbent can be degraded by exposure to ambient air, provisions can be made to permit packaging and hermetic sealing under an inert gas atmosphere.

In a preferred embodiment of the invention, the adsorbent is powdered, granular, spherical, or pelletized activated carbon, zeolite, molecular sieve, polymeric adsorbent, or silica gel. The adsorbent is preferably contained within its own container such as a cloth bag. For many application the packaging is preferably a laminated polyethylene-aluminum foil bag into which the object is placed. The maximum recommended temperature to which such a bag can be exposed is typically 90° C. Therefore the adsorbent container is heated to a temperature of between about 40° and 90° C. The hot adsorbent container is then placed into the aluminum foil bag and immediately heat sealed to provide a hermetic seal. The package is then cooled.

In an another preferred embodiment of the invention, the adsorbent is powdered, granular, spherical, or pelletized activated carbon, zeolite, molecular sieve, polymeric adsorbent, or silica gel. The adsorbent is contained within a closed small cloth bag. The packaging is a laminated polyethylene-aluminum foil bag. The contents are placed into the aluminum foil bag together with the cloth bag containing the adsorbent. The maximum recommended temperature to which the bag or the material, object, and/or device intended for storage can be exposed is about 90° C. Therefore the aluminum foil bag containing the adsorbent containing cloth bag and the material, object, and/or device intended for storage is heated to a temperature between 40° and 90° C. The aluminum foil bag is then immediately heat sealed to provide a hermetic seal. The package is then cooled. The packaging provides an effective barrier against contamination as long as the integrity of the package is maintained. Other advantages of the invention will become apparent from a perusal of the following detailed description of presently preferred embodiments taken in connection with the accompanying drawing.

PRESENTLY PREFERRED EMBODIMENTS

Figure 1:
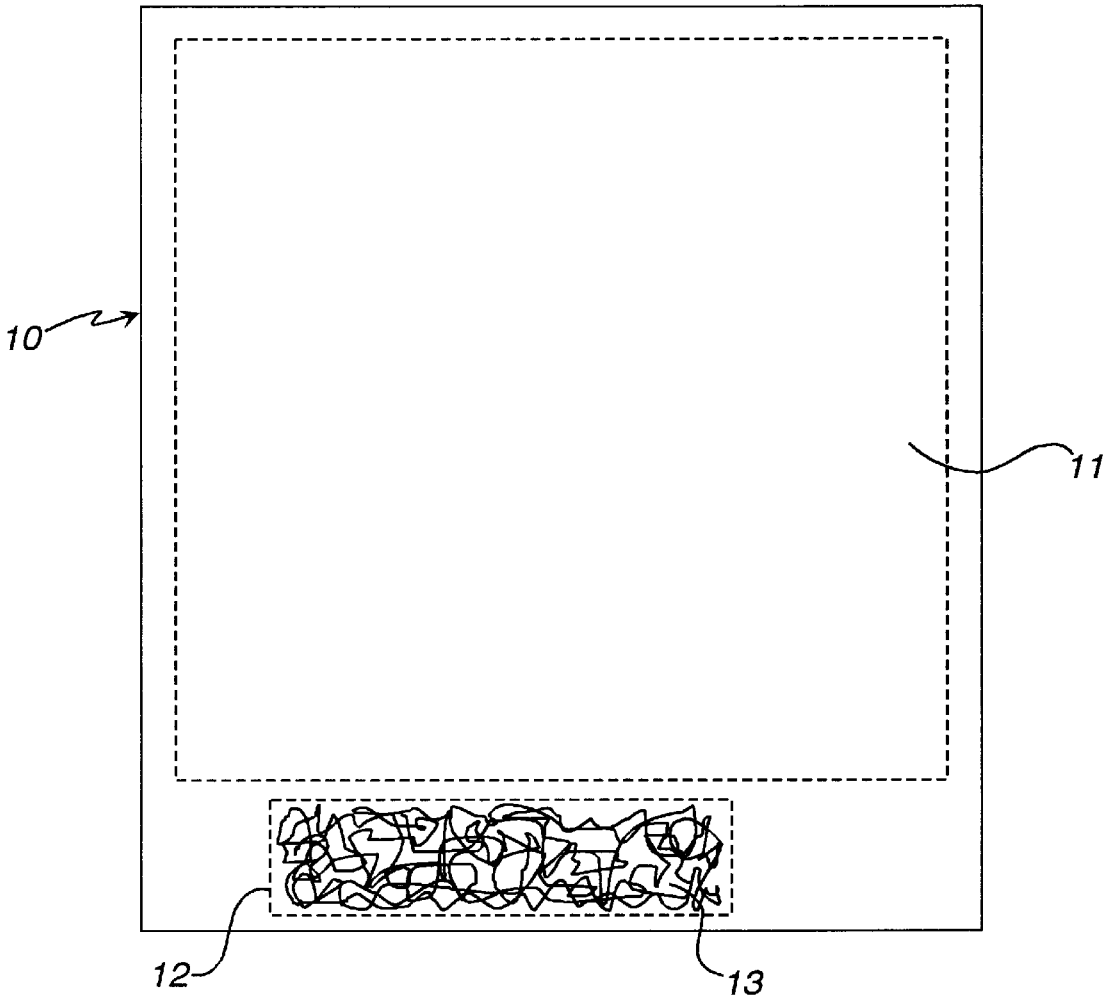
FIG. 1 is an illustration of a package containing an adsorbent in accordance with the present invention.

The following examples illustrate preferred embodiments of the present invention but are not intended to limit the scope of the present invention.

EXAMPLE 1

With reference to FIG. 1, a package 10 comprising an aluminum foil bag having the approximate dimensions of 3 inches by 4 inches by 8 inches. At room temperature, a computer board (peripheral input/output board) was placed into the package 10. Therein was placed a closed bag 12 fabricated from cotton cloth containing 50 grams of an activated carbon 13, having a surface area of approximately 1000 meters squared per gram, at a temperature of approximately 75° C. The approximate dimensions of the cotton bag were 1 inch by 3 inches by 4 inches. An oven was used to heat the activated carbon containing cotton bag prior to introduction into the aluminum foil bag 10. Immediately after placement of the activated carbon containing cotton bag 12 into the aluminum foil bag 10, the aluminum foil bag was heat sealed. The bag contents were then allowed to cool to ambient temperature. As the adsorbent cooled, the volume of the aluminum foil bag packaging was observed to decrease due to the action of the ambient pressure on the partially evacuated aluminum foil bag.

EXAMPLE 2

At room temperature, 450 grams of pistachio nuts were placed into a package comprising a polypropylene plastic bag equipped with a track seal. Into this bag was placed a closed bag fabricated from cotton cloth containing 50 grams of an activated carbon having a surface area of approximately 1000 meters squared per gram at a temperature of approximately 75° C. The approximate dimensions of the cotton bag were 1 inch by 3 inches by 4 inches. An oven was used to heat the activated carbon containing cotton bag prior to introduction into the polypropylene bag. Immediately after placement of the activated carbon containing cotton bag into the polypropylene bag, the polypropylene bag was sealed. The bag contents were then allowed to cool to ambient temperature. As the adsorbent cooled, the volume of the bag was observed to decrease due to the action of the ambient pressure on the partially evacuated bag. Visually, it was observed that the bag was tightly constricted around its contents and the outer contours of many of the pistachio nuts were duplicated on the exterior bag surface.

At room temperature, powdered iron was placed into a heavy-walled glass bottle having a gasketed lid. Into this bottle was placed a ventilated plastic packaging containing 50 grams of an silica gel at a temperature of approximately 75° C. The approximate dimensions of the ventilated plastic packaging were 1 inch by 3 inches by 4 inches. An oven was used to heat the silica gel containing ventilated plastic packaging to a temperature of approximately 75° C. prior to introduction into the bottle. Immediately after placement of the silica gel containing ventilated plastic packaging into the glass bottle, the bottle was sealed. The bottle contents were then allowed to cool to ambient temperature.

While presently preferred embodiments of the invention have been shown and described, the invention may be otherwise embodied within the scope of appended claims.

What is claimed is:

1. A package comprising:

a) a gas impermeable hermetically sealable package for receiving contents wherein said package has an interior pressure equal to ambient and resistant to temperatures above ambient; and b) a high porosity heatable adsorbent wherein said absorbent is heated and positioned within said package at a temperature above said ambient temperature to reduce the pressure therein below ambient when said envelope is hermetically sealed and cooled.

2. A package as set forth in claim 1 wherein said adsorbent is selected from the group consisting of zeolite, activated carbon, molecular sieve, polymeric adsorbent, and silica gel and combinations thereof.

3. A package as set forth in claim 1 or 2 wherein said adsorbent is enclosed within a gas permeable container within said envelope.

4. The package of claim 1 wherein said interior pressure of said package is further reduced by a mechanical means or pump prior to sealing.

5. The package of claim 1 wherein said contents are selected from the group consisting of electronic components, electronic devices, semiconductors, machines, art works, metal, ceramic, wood, books, newspapers, magazines, papers, glass, electronic assemblies, tools, metallic objects, ceramics, plastics, measuring devices, and sensors.

6. The package of claim 1 wherein said contents are selected from the group consisting of seeds, freeze-dried materials, dried foods, or chemicals having low vapor pressures.

7. The package of claim 6 wherein said gas permeable container is fabricated from cloth.

8. The package of claim 1 wherein said adsorbent is contained in a gas permeable container prior to placement in said package.

9. The package of claim 1 wherein said adsorbent is powdered, granular, pellet, cloth, or formed into blocks, plates, cylinders, or other free standing shapes.

10. The package of claim 1 wherein said adsorbent is impregnated.

11. The package of claim 1 wherein said adsorbent is an activated carbon, silica gel, zeolite, molecular sieve, polymeric adsorbent, and combinations thereof impregnated with a metal, a salt, an acid, a base, or an organic compound.

12. The package of claim 1 wherein said adsorbent is a catalytically active carbonaceous char.

13. The package of claim 1 wherein said package is selected from the group consisting of bottles, bags, drum boxes, or irregularly shaped containers produced by molding, stamping, or otherwise forming metal, glass, and/or plastic.

14. The package of claim 1 wherein said hermetic sealing is by heat-sealing, gluing, welding, brazing, mechanical closures or clamps, or compression.

15. A method for packaging contents at a pressure less than ambient comprising the steps:

a) positioning contents within a hermetically sealable gas impermeable package having an interior pressure equal to ambient;

b) heating above ambient temperature a high porosity adsorbent;

c) positioning said heated adsorbent in said package for reducing the interior pressure to below ambient therein;

d) hermetically sealing said package; and e) cooling said package and contents to ambient temperatures.

16. The method of claim 15 wherein the adsorbent is heated prior to placement into said package.

17. The method of claim 15 wherein the adsorbent is heated after placement into said package and before said hermetic sealing of said package.

18. The method of claim 15 where said adsorbent is incorporated into said package.

19. The method of claim 15 wherein said cooling is by convection, forced air circulation, refrigeration, or any combination thereof.

* * * * *